US005732457A

United States Patent [19]

Ishiwata et al.

[11] Patent Number: 5,732,457

[45] Date of Patent: Mar. 31, 1998

[54] ELECTRICAL WIRE HARNESS BINDING APPARATUS

[75] Inventors: Yoshio Ishiwata, Isehara; Tsutomu Kamojima; Tsutomu Ishii, both of Toyama-ken; Junsei Tsuji, Tonami; Hideki Katayama, Toyama-ken, all of Japan

[73] Assignee: Molex Incorporated, Lisle, Ill.

[21] Appl. No.: 652,059

[22] Filed: May 23, 1996

[30] Foreign Application Priority Data

May 25, 1995 [JP] Japan ..... 7-150916

[51] Int. Cl.[6] ..... H01R 43/04; B32D 31/10

[52] U.S. Cl. ..... 29/564.7; 29/759; 53/591; 156/468

[58] Field of Search ..... 29/33 M, 566.3, 29/564.4, 742, 759, 564.6, 564.7; 156/468; 53/591; 100/18

[56] References Cited

U.S. PATENT DOCUMENTS

| | | | |
|---|---|---|---|
| 3,160,930 | 12/1964 | Fisher . | |
| 3,168,617 | 2/1965 | Richter . | |
| 3,239,916 | 3/1966 | Love . | |
| 3,245,860 | 4/1966 | Aurich et al. . | |
| 3,622,687 | 11/1971 | Doughty | 174/117 |
| 3,955,264 | 5/1976 | Klappert | 29/203 |
| 4,290,179 | 9/1981 | Bakermans et al. | 29/33 |
| 4,311,544 | 1/1982 | Salopek et al. | 156/510 |
| 4,360,400 | 11/1982 | Davis et al. | 156/468 |
| 4,457,662 | 7/1984 | Ireland et al. | 414/331 |
| 4,486,253 | 12/1984 | Gonia | 156/51 |
| 4,767,891 | 8/1988 | Biegon et al. | 174/34 |
| 4,777,711 | 10/1988 | Forkner | 29/566.3 |
| 4,838,407 | 6/1989 | Komuro | 198/406 |
| 4,885,838 | 12/1989 | Ruecker et al. | 29/566 |
| 4,923,537 | 5/1990 | Matsushima | 156/48 |
| 4,925,007 | 5/1990 | Gerst et al. | 29/759 X |
| 4,980,958 | 1/1991 | Suzuki et al. | 29/33 M |
| 5,005,611 | 4/1991 | Hecker | 140/147 |
| 5,010,642 | 4/1991 | Takahashi et al. | 29/868 |
| 5,016,345 | 5/1991 | Aligne et al. | 29/742 |
| 5,179,775 | 1/1993 | Bogotzck et al. | 29/564.4 |
| 5,274,195 | 12/1993 | Murphy et al. | 174/117 |
| 5,525,188 | 6/1996 | Ingwersen | 29/759 X |

FOREIGN PATENT DOCUMENTS

| | | | |
|---|---|---|---|
| 2158747 | 6/1973 | France | 53/591 |
| 3-283207 | 12/1991 | Japan . | |
| 5-159640 | 6/1993 | Japan . | |
| 6-236790 | 8/1994 | Japan . | |

*Primary Examiner*—William R. Briggs
*Attorney, Agent, or Firm*—Charles S. Cohen

[57] ABSTRACT

A wire harness bundling apparatus includes carrier means for carrying harness wires sequentially, shifting means responsive to the amount of the harness wires carried for shifting the harness wires to an apparatus guide means, tape feeding means placed so as to permit the tape to traverse the harness wire pathway between the guide means. The tape is wound around a bundle of harness wires and upper and lower melting-and-pinching means melts and pinches portions of the tape on opposite sides of the harness wire bundle. A drive means drives the upper and lower melting-and-pinching means together to actuate a severing knife placed between the forward and rearward sides of the binding tape.

19 Claims, 10 Drawing Sheets

ELECTRICAL WIRE HARNESS BINDING APPARATUS

BACKGROUND OF THE INVENTION

The present invention relates generally to an electrical wire harness binding apparatus which automatically binds a predetermined number of electrical harnesses together to form a bundle of harnesses.

In the production of wire harnesses, it is common for a predetermined number of wire harnesses to be bound together manually with rubber bands at the wire portions thereof to form a bundle of harnesses. A number of bundles are then collected, packaged and transferred to a subsequent working station or a warehouse. This manual labor, however, cannot be performed at an increased efficiency and an incorrect number of wire harnesses are sometimes bound. Also, the removal of the rubber bands from the bundles of wire harnesses to unbind them for subsequent use is tedious work because the rubber bands are likely to catch on the terminals or connectors of the wire harnesses.

SUMMARY OF THE INVENTION

Therefore, it is an object of the present invention to provide a wire harness binding apparatus which reliably and automatically binds together a predesired number of wire harnesses into a bundle of wire harnesses.

Another object of the present invention is to provide a wire harness binding apparatus which can bind automatically binds the harness wires to form bundles of harnesses in a manner which permits the unbinding of such bundles with ease.

To attain these objects, the present invention provides an electrical wire harness binding apparatus which includes carrier means for carrying the wires of the harnesses sequentially; shifting means responsive to the number of harness wires carried by the carrier means for shifting the wires perpendicularly to the lateral direction in which the wires are laid; guide means for guiding the wires to binding positions; tape feeding-and-stretching means placed near the end of the guide means for feeding a binding tape across the guide means in opposition to the harness wires, thereby permitting the tape to wind around the wires collected in the guide means; upper and lower tape application means disposed downstream of the tape feeding-and-stretching means for applying the tape to opposite sides of the bundle of harness wires; drive means for driving the upper and lower heating-and pinching means toward each other; and cutting means for cutting the binding tape after application to the wire harness bundle.

The present invention provides an apparatus for binding together any selected number of completed wire harnesses in which the wires are terminated with connector elements at opposite ends of the harnesses. The guide means may include pairs of elongated rails, one of which serves as a stationary guide and the other of which serves as a movable guide which is biased against the stationary guide. The harness wire shifting means may include a ram for urging the harness wires held between the guides to a tape-application position.

The upper and lower heating-and-pinching means may each include first and second operative heating units and the cutting means may be placed between the first and second heating units in order to cut the tape between sealed areas of sequential application of tapes. In an alternative embodiment, a single heating-and-pinching set may be used which is driven into an operative position twice on opposite sides of the wire harness bundle. The cutting means may be placed in such a position that it may cut the tape between such two sealed areas.

At least one of the sealed areas of the application tape may be formed in a manner such that it is easily separable to permit the unbinding of the bundle of harness wires. Such separable areas may be provided by melting and pinching the folding lengths of tape at selected points. The wire binding apparatus may also be used to apply various harness identifying indicia in alphanumeric form to represent lot numbers, manufacturing dates or other similar information.

The harness bundling apparatus of the present invention may be positioned downstream of a harness assembly machine which fashions the wire harnesses by affixing terminals or connectors to opposing ends of the harness wires. The carrier means of the present invention may encompass a transfer section of the harness assembly machine. When the carrier means collects a predetermined number of completed wire harnesses, the wires portions of the harnesses are shifted perpendicularly to the direction of the wires into a position where they can be received by the guide means. The wires are then held between the stationary and biased guides in a ready position for taping.

Rolls of a thermo-adhesive, synthetic resin tape may be placed within the apparatus at levels above and below the guide means in the path of the wire harnesses, and the binding tape is then drawn from the upper roll and lower roll in a manner to stretch the tape. Once stretched, the wires are urged forward into abutting contact with the tapes, which are then wound around the wires so that adhesive surfaces thereof meet together on the rear side of the bundle of harness wires.

The tape is positioned between the upper and lower heating-and-pinching means, which are then driven close toward other to thereby pinch the tapes together on the rear side of the bundle of harness wires. The heating-and-pinching means may includes a high-frequency, induction heating sealing unit or supersonic sealing unit in order to provide an effective sealing of tapes in two selected areas. The tapes are cut between the two sealed tape areas to provide a bundle of harness wires, which moves forward, while leaving a sealed tape area behind it in the harness wire path. The upper and lower tapes diverge from the sealed tape area in a standby position for winding about subsequent bundles of harness wires.

One of the sealed areas is preferably a spot-sealed area, which is easily separable for unbinding by fingers. The spot-sealing may be effected to provide alphanumeric patterns for identification.

These and other objects, features and advantages of the present invention will be clearly understood through a consideration of the following detailed description.

BRIEF DESCRIPTION OF THE DRAWINGS

In the course of the following description of the detailed description, reference will be made to the attached drawings wherein like reference numerals identify like parts and wherein.

DETAILED DESCRIPTION OF PREFERRED EMBODIMENTS

Figure 10:
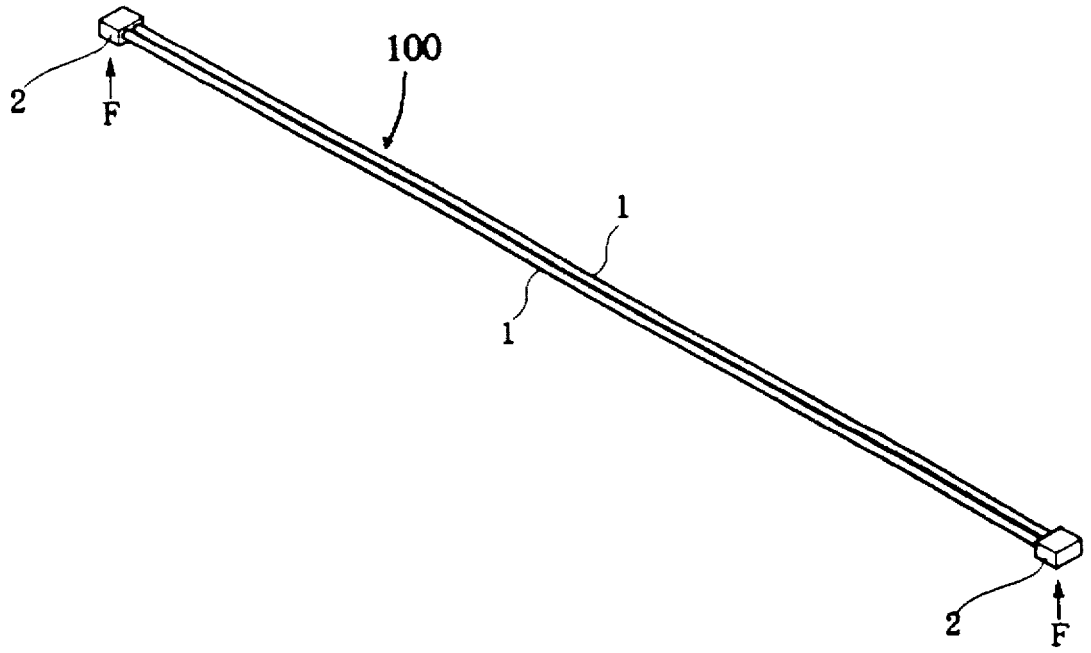
FIG. 10 is a perspective view of an electrical wire harness suitable for bundling with the present invention.

FIG. 10 illustrates a completed wire harness 100 formed from two electrical wires 1 which are combined together by terminating terminals blocks, or connectors 2, to their opposing ends. Each terminal block 2 is preferably of the insulation displacement style, having at least one conductive spike or blade disposed inside of it, which pierces the exterior insulation of the wire 1 until it reaches and contacts the internal conductor of the wire (not shown) to effect an electrical connection between the terminal block 2 and the conductor of the insulated wire 1 as is known in the art.

This type of termination is usually automatically performed by an automated terminating machine known in the art. In such machines, wires are arranged in a parallel order, measured a specific distance, and cut to obtain a given length. The measured and cut wires are then terminated to terminal blocks or connectors at their opposing ends in order to form wire harnesses. Terminal blocks of different sizes may be used to combine two or more electrical wires into the completed wire harnesses 100.

In some instances during termination of wire harnesses, one terminal block may be applied to one set of ends of the wires, while the other ends of the wires are stripped. In other instances, one terminal block is applied to one set of ends of the wires, and two or more terminal blocks of different sizes are applied to the other ends of the wires. Once the wires are terminated, the harnesses appear in sequential order at the exit of the termination machine. The present invention finds utility in placement at this exit.

Figure 1:
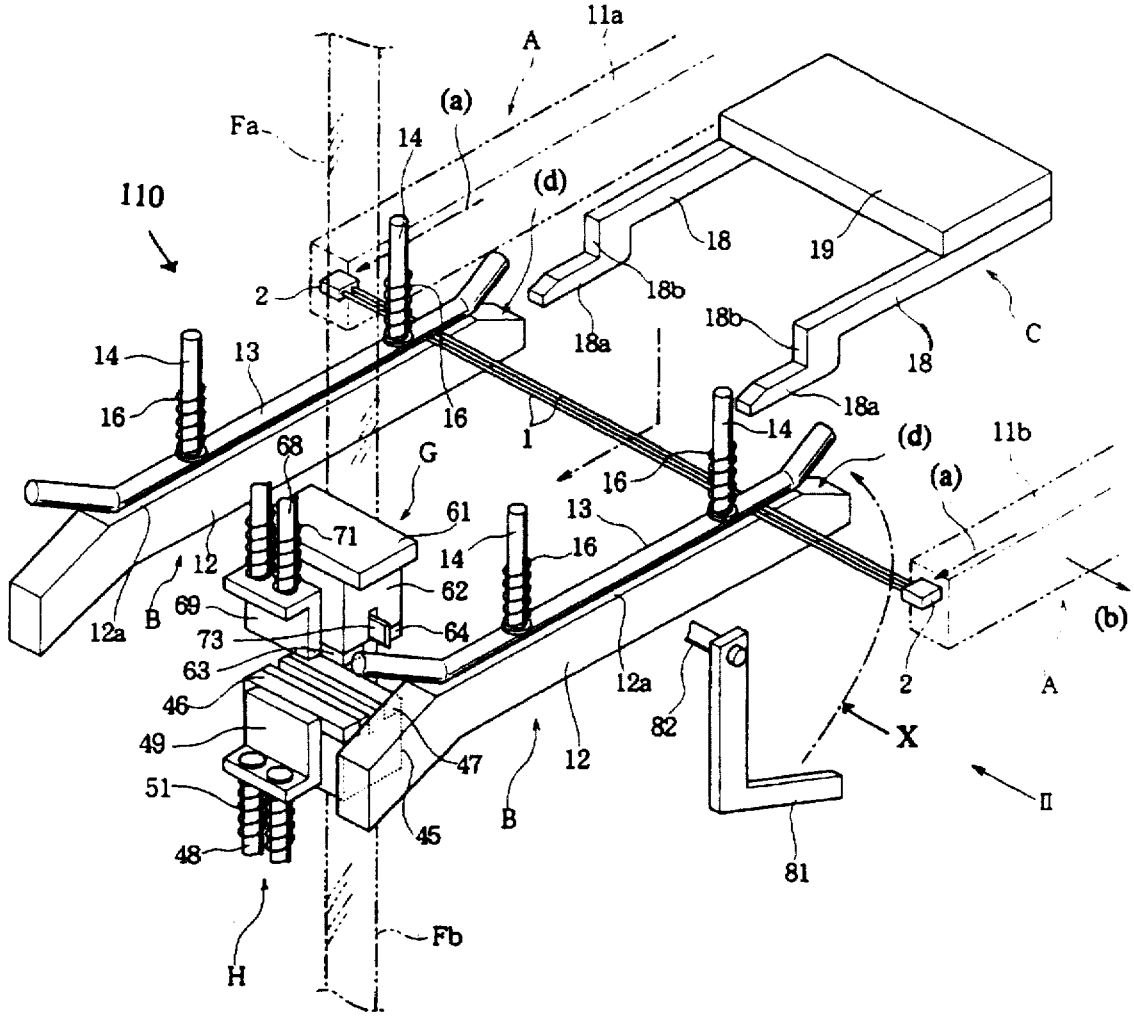
FIG. 1 is a perspective view an electrical wire harness bundling apparatus constructed in accordance with the principles of the present invention.

Referring now to FIG. 1, a completed harness 100 is illustrated in place within a wire harness binding apparatus 110 constructed in accordance with the principles of the present invention. The binding apparatus 110 is seen to include the following assemblies: carrier means A for carrying wire harnesses 100 sequentially; shifting means C for shifting these wire harnesses 100 in a direction perpendicular to the axes of the wires; parallel guide means B for guiding the harness wires 1 to sequential working positions; tape feeding-and-stretching means E (FIG. 2) placed at a wire-abutting position G so as to position a binding tape across the wire pathway of the guide means B; upper and lower tape heating-and-pinching means H placed downstream of the tape feeding-and-stretching means E for heating, melting and pinching the portion of the binding tape surrounding the bundle 120 of harness wires 1 on both the forward and rearward sides of the bundle 120; drive means for driving the upper and lower heating-and-pinching means close to each other; and severing means placed between the heating-and-pinching means.

In the particular embodiment illustrated in FIG. 1, the carrier means A includes a portion of the transfer section or outlet of the aforementioned termination machine, which transfer section includes a pair of transfer guide extensions **11*a* and 11*b*, preferably spaced apart and generally parallel to each other. In the termination machine, wires are cut at given lengths and terminated and one of the transfer guide extensions 11*a* and 11*b* may be laterally moved (indicated by "b" in FIG. 1) so as to control the lateral space between the transfer guide extensions 11*a*, 11*b*, in accordance with the predetermined length of the wires. The harness wires 1** are moved perpendicularly relative to their axes (as indicated by "a") to be positioned at the outlet of the transfer guide extensions at regular time intervals in accordance with their production.

Figure 2:
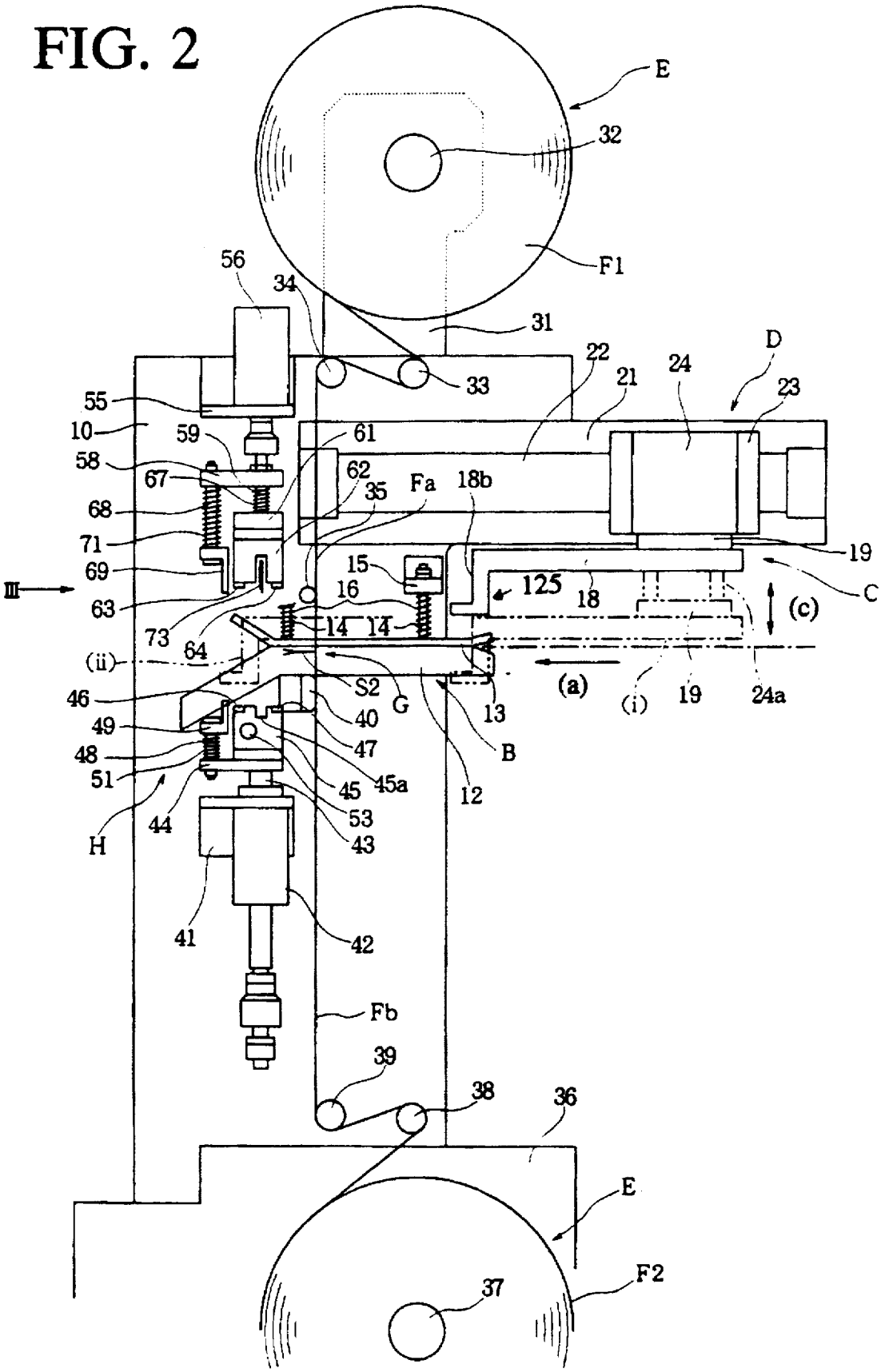
FIG. 2 is an elevational view of a portion of the harness bundling apparatus of FIG. 1, as viewed generally along arrow II of FIG. 1.

A guide means B is preferably positioned downstream of the outlet of the transfer guide extensions **11*a* and 11*b* to receive the completed wire harnesses 100 in sequential order. The guide means B includes a pair of spaced apart, elongated, stationary guide members 12 of predetermined length and an elongated confronting spring-biased guide member 13 which is biased against the upper surface 12*a* of each stationary guide member 12. Each biased guide member 13 is fixed to a pair of posts 14 which have a coil spring 16 wound therearound and compressed between an associated adjustable stop member 15 and the guide member 13, as best shown in FIG. 2. The biased guide members 13 are movable upwardly under the advancement of wire harnesses 100 through the guide means A. The guide means B is supported on the frame 10 of the harness binding apparatus 110**.

The shifting means C includes a flat plate 19 having two arms 18 integrally connected to opposing sides thereof. Each arm 18 has vertical and horizontal extensions **18*b* and 18*a* which cooperate to define a step 125 at its end. A drive unit D is operatively associated with the shifting means C and includes, as illustrated in FIG. 2, a longitudinal support 21 fixed to the apparatus frame 10, a horizontal pneumatic cylinder 22 fixed to the support 21 and a reciprocating slider 23 driven by the cylinder 22. The slider 23 is equipped with a vertical pneumatic cylinder 24 which effects upward and downward movement of the shifting means C. The shifting means C is operatively connected to the vertical cylinder 24 of the slider 23 via rods 24*a* which engage the plate 19** of the shifting means C.

The shifting means C is movable from the original position (shown in solid lines) to the lower, start position "i," shown in phantom in FIG. 2. The horizontal cylinder 22 then drives the shifting means C forward between the start position "i" and the final position "ii," shown in phantom at the left of FIG. 2. When the harnesses 100 produced at the outlet of the transfer section A reach a predetermined number, the harnesses 100 are moved by the shifting means C, particularly the front risers **18*b* of the arms 18 thereof to shift the harness wires 1 thereof forward in a group in the direction indicated by "a." Then, the harness wires 1 are pinched between the stationary and biased guide members 12, 13** of the guide means B.

As seen from FIG. 2, the tape feeding-and-stretching means E includes two tape rolls F1, F2 spaced apart from each other. The upper tape roll F1 has a center axle 32 which is rotatably fixed to a vertical support 31 extending from the apparatus frame 10. The center axle 32 is rotatable against a predetermined load, and the tape Fa is pulled out from the upper tape roll F1, passing by guide rollers 33 and 34 and by an alignment roller 35 to reach the wire abutting position G which is located between the guide means B and interposed in the wire pathway.

Figure 5:
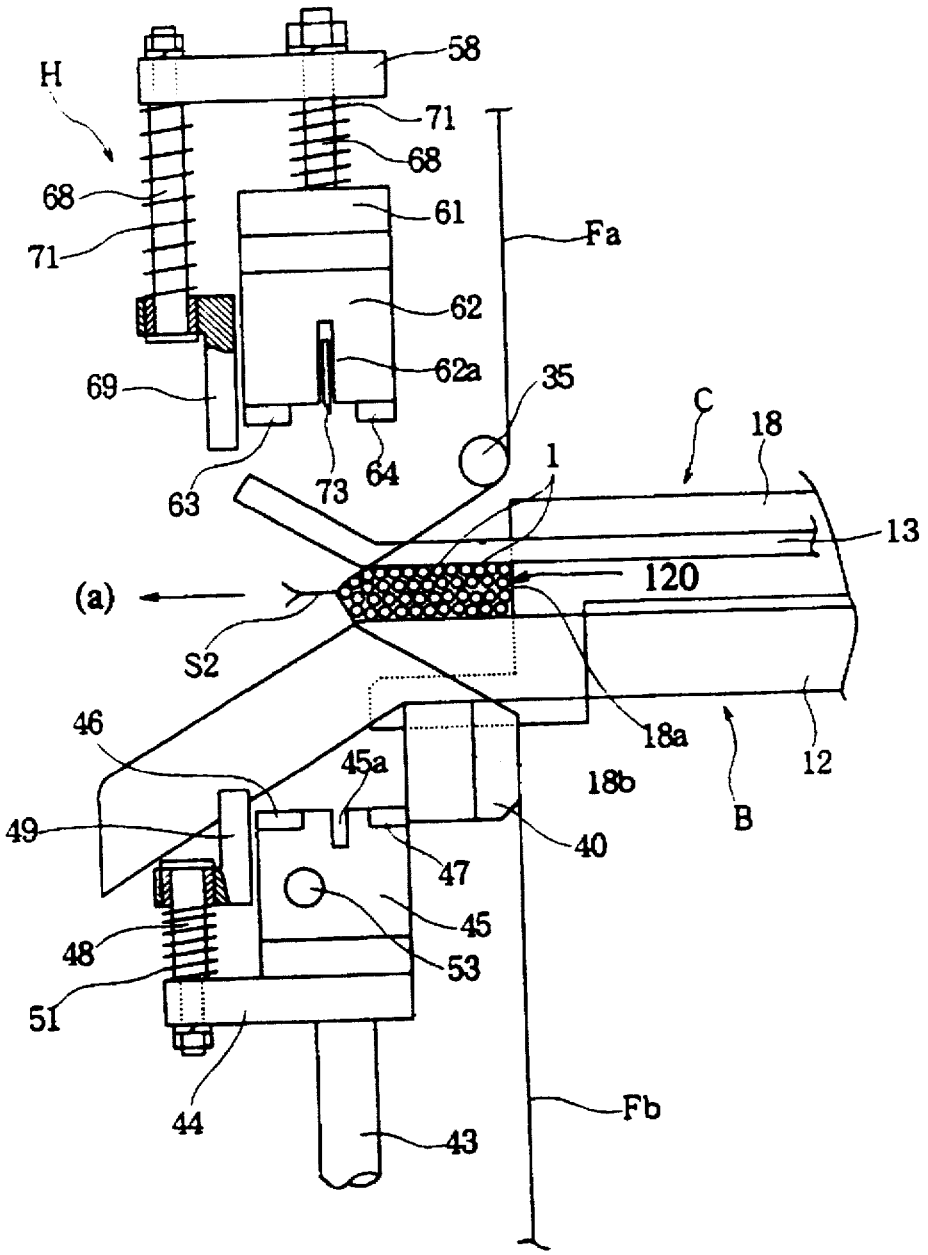
FIG. 5 is an enlarged elevational view of the binding tape application area illustrating how the binding tape is contacted by an advancing bundle of harness wires.

Similarly, the lower tape roll F2 has a center axle 37, which is rotatably fixed to a support 36 extending from the apparatus frame 10. The center axle 37 is rotatable against a predetermined load, and the tape Fb thereon is pulled out from the lower tape roll F2, passing by guide rollers 38 and 39 and by an alignment pad 40 to reach the wire-abutting position G, where the tapes Fa and Fb meet together to be heated and melted on their adhesive sides in order to adhere them together to provide a forward sealing area as indicated by S2. (FIG. 5.) The guide rollers 33, 34, 38, 39, and the alignment roll 35 are rotatably fixed to the frame 10, as is the alignment pad 40. The binding tape is preferably a thermo-adhesive synthetic resin tape, such as polyacrylonitrile film.

Figure 6:
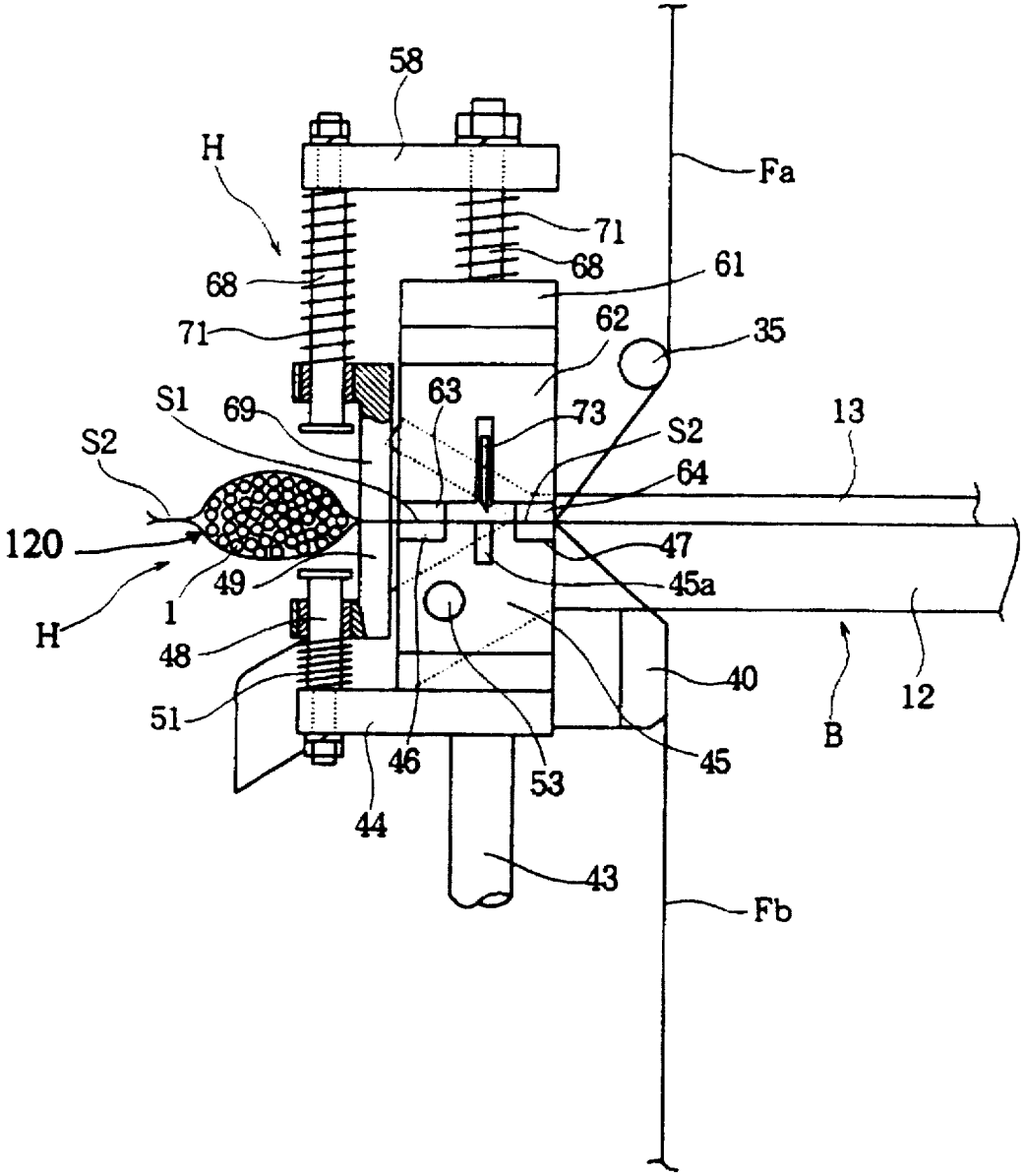
FIG. 6 is the same view as FIG. 5, but illustrating how the binding tape is applied around the advancing bundle of harness wires, and how portions of the binding tape are sealed behind the bundle of harness wires.

The upper and lower heating-and-pinching means H is located downstream of the wire-abutting position G. As seen in FIGS. 5 and 6, the harness wires 1 are moved forward by the shifting means C into abutting engagement with the forward sealed area S2 of the two binding tapes Fa and Fb. Further forward movement of the group of harness wires causes the tapes Fa and Fb to, in effect, wind around the harness wires 1 so that their adhesive surfaces mate together on the rear side of the bundle of harness wires 1 in alignment with and between the upper and lower heating-and-pinching means H.

As seen from FIG. 2, the lower assembly of the heating-and-pinching means H is disposed below the guide means B, and includes a pneumatic cylinder drive unit 42, fixed to a lateral support 41 of the apparatus frame 10. A heater assembly 45 is mounted to the piston rod 43 of drive unit 42 via an associated support plate 44 and has a heating element 53 embedded therein. A slot 45a is present in the heater assembly 45 between first and second heating pads 46, 47. These heating pads 46, 47 are preferably thermo-conductive metal plates. The support plate 44 of the heater assembly 45 may include a bolt 48 and a slidable pincher piece 49 slidably fixed thereto with a compression spring 51 wound thereabout between the support plate 44 and the pincher piece 49, thus imparting a constant upward force.

Figure 3:
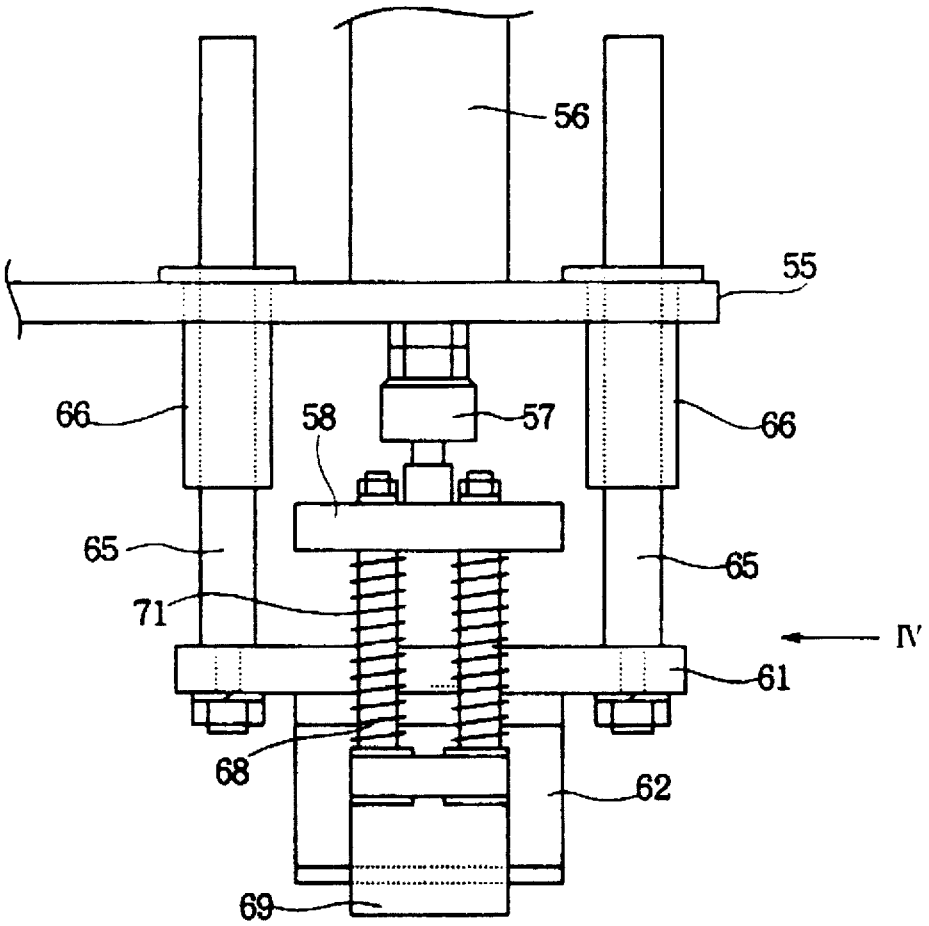
FIG. 3 is a front elevational view of the apparatus of FIG. 1 illustrating the upper heating-and-pinching unit, as viewed generally along arrow III of FIG. 2.
Figure 4:
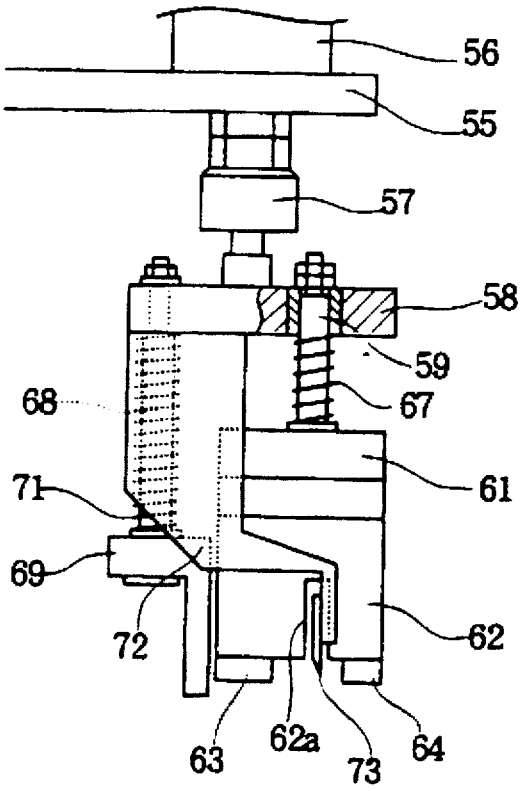
FIG. 4 is a side partial elevational view of the upper heating-and-pinching unit of the harness bundling apparatus of FIG. 1, as viewed generally along arrow IV of FIG. 3.

The upper assembly of the heating-and-pinching means H is disposed above the guide means B. As seen from FIGS. 3 and 4, it includes a pneumatic cylinder drive unit 56 and 57 fixed to a lateral support 55 of the apparatus frame 10, and a reaction block 62 fixed to the piston rod 57 of drive unit 56 via associated support plate 58 and movable stage 61. The support plate 58 has a rod 59 passing therethrough, and the rod 59 is operatively connected to the movable stage 61 by a compression spring 67 wound therearound, thus exerting a constant downward force or the movable stage 61 as seen from FIG. 4. The movable stage 61 further has two guide rods 65 slidably fitted in the bearings 66 of the lateral support 55. The reaction block 62 has a slot 62a formed in its lower surface and first and second reaction, or contact pads, 63, 64 are fixed to the reaction block 62 on the opposite sides of the slot 62*a*.

As seen best from FIG. 5, the heating-and-pinching means H has first and second sets of heating-and-pinching surfaces. The first set of heating-and-pinching surfaces includes the first heating pad 46 of the lower assembly and the first contact pad 63 of the upper assembly. A second set of heating-and-melting surfaces is made up by the second heating pad 47 of the lower assembly and the second contact pad 64 of the upper assembly. These first and second sets are disposed downstream of the wire abutting position G, where the tapes Fa and fb wind around the electric wires 1 so that their adhesive surfaces meet together on the rear side of the bundle of electric wires 1.

The support plate 58 of the upper assembly has an additional stud 68 fixed thereto, and a slidable pincher piece 69 is fixed thereto and includes a compression spring 71 therearound, to exert a constant downward force on the slidable pincher 69. As seen from FIG. 4, the support plate 58 has a knife holder 72 with a cutting knife 73 fixed thereto. The cutting knife 73 is received within and extends from the slot 62*a* of the upper assembly. The edge of the slot 45*a* of the lower heating element 45 is aligned with the cutting knife 73 to cooperate in shearing the tape.

As seen in FIG. 6, the mating area of tapes Fa and Fb located upstream of the bundle 120 of harness wires is pinched between the upper reaction block 62 and the lower heating assembly 45 so that the first heating pad 46 and its opposing contact pad 63 heat and melt the mating areas of tapes Fa and Fb to form a first sealed area S1. The second heating pad 47 and its opposing contact pad 64 heat and melt the mating areas of tapes Fa and Fb to form a second sealed area S2.

If desired, the first heating pad 46 or its opposing contact pad 63 may include minute projections distributed on its surface which, in effect, will form a sealed area that can be easily separated. The second heating pad 47 and its associated contact pad 64 of the second set have substantially flat surfaces which, in effect, form a sealed area of the binding tape that cannot be separated. Accordingly, the present invention bundles wire harnesses together with strips of tape which have separable and inseparable sealed areas S1 and S2 on opposite ends of the wire harness bundles 120.

As seen from FIG. 6, the knife 73 cuts the opposing tapes Fa and Fb between their respective separable and inseparable sealed areas S1 and S2 upstream of the bundle of harness wires, leaving an inseparable sealed area S2 at the wire abutting position G. The next group of harness wires 1 are then pushed into contact with the sealed area of tape so that the binding tape winds about the harness wires. For this reason, the sealed area S2 is inseparable because otherwise the sealed area may become separated during the advancement of the harness wires.

As seen from FIG. 1, a rotatable arm 81 may be driven by a suitable drive means (not shown) to rotate about its pivot 82 in the direction indicated by the dashed arrow X. When a predetermined number of wires 1 are carried by the shifting means C to the guide means B, the arm 81 rotates to hold the harness wires 1 together as a group, thereby preventing any of the harness wires 1 from slipping off from the stationary and biased guide members 12, 13.

The operation of the wire bundling apparatus shall now be described. After the bundling of a preceding group of harness wires and before the beginning of bundling of a subsequent group of harness wires, the lower heating assembly 45 is raised by the lower cylinder drive 42, and the upper heating assembly 62 is lowered by the upper cylinder drive 56 so that the tapes Fa and Fb diverge from their second sealed area S2 at the wire abutting position G (FIG. 6). This closes the trailing edge of the preceding group of harness wires and seals the leading edge of the subsequent group of harness wires.

As the termination machine applies terminal blocks to wires to form wire harnesses, the harnesses 100 are directed to the guide means B via the transfer guide outlets 11*a* and 11*b*, and the harness wires thereof 1 are pinched between the stationary guide member 12*a* and the biased guide member 13. Almost all of the harness wires 1 thus transferred may be pushed in between the stationary and biased guide extensions 12, 13, but some of the harness wires 1 ride on the rear slanted surfaces "d" of the stationary guide members 12*a*. These harness wires 1, however, do not fall down because the transfer guide extensions 11*a* and 11*b* extend beyond the slanted surfaces "d" of the stationary guide 12*a* in an overlapping fashion.

When the predetermined number of harness wires 1 to be bundled appear at the outlet of the transfer guide extensions 11*a* and 11*b*, the driving unit D begins its cycle. The number of harness wires 1 appearing at the outlet of the carrier means A is determined in terms of terminating cycles of the termination machine, and when the number has reached its predetermined value, an electric control in the termination machine sends a signal to a like electric control in the wire binding apparatus 110, and the driving unit D begins transferring the harness wires to the wire abutting position G.

First, the vertical cylinder unit 24 of the driving unit D lowers the arms 18 of the shifting means C to the position "i" indicated in phantom lines in FIG. 2. Then the horizontal cylinder unit 22 drives the slider 23 toward the position "ii" indicated in phantom in the longitudinal direction indicated by arrow "a."

After the arms 18 move forward from the position "i," the wires 1 which are sandwiched between the stationary guide member 12 and the biased member 13 are pushed forward by the risers 18b of the arms 18, thus leaving the transfer guide extensions 11*a* and 11*b*. At this time, the holding arm 81 preferably rotates in the direction indicated by arrow "x," thereby preventing any harness wires 1 from falling off from the slanted surface "d" of the stationary guide members 12. In cases where relatively long electric wires are handled, the transfer guide extension 11*b* may be shifted laterally as indicated by "b" to adjust the lateral space between transfer guide extensions 11*a*, 11*b* to accommodate the harness wire lengths.

The harness wires 1, while being held between the stationary guide members 12 and the biased guide members 13, are pushed downstream by the risers 18*b* of the arms 18 in the direction "a," that is, perpendicular to the lateral extent of the harness wires 1. The harness wires 1 arrive at the wire abutting position G where the upper and lower tapes Fa and Fb diverge from the second sealed area S2. The electric wires 1 are moved forward, causing the diverging tapes to, in effect, wind around the bundle of harness wires 1 so that their adhesive surfaces are brought together on the rear side of the bundle of harness wires 1, as seen in FIG. 5. The upper tape Fa is stretched and pays out via the alignment roll 35 whereas the lower tape Fb is stretched and pays out via the alignment pad 40.

The wires 1 are pushed further forward by the arms 18 in the longitudinal direction "a" to the extent they reach the position "ii" and the harness wires leave the contact of stationary and biased guide members 12, 13 at which point the trailing tape portion at the position in which the heating units 45, 62 confront each other. Here, the trailing tape portion is heated and cut simultaneously, so that the rear side of the harness wire bundle is sealed to provide sealed area S1, and also cut to define another sealed area S2 behind it in place at the wire position G. Prior to the melting-and-cutting of the tape, the transfer means C returns to the original position "i" by the linear piston-and-cylinder unit 24.

Figure 7:
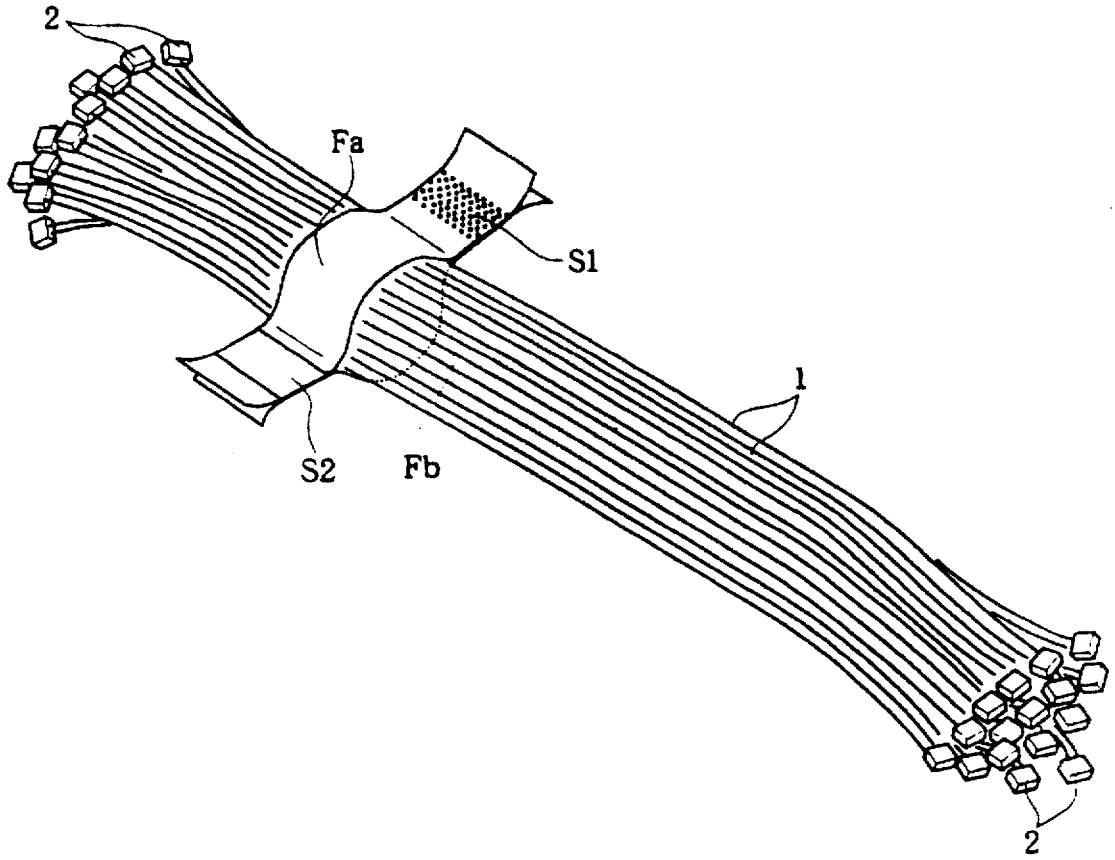
FIG. 7 is a perspective view of a bundle of wire harnesses bound together with a binding tape as produced by the harness wire bundling apparatus of FIG. 1.

In the heating-and-melting station, the lower piston-and-cylinder unit 42 raises the support plate 44 to bring the heating assembly 45 and the pinching piece 49 to the position shown in FIG. 6. Simultaneously with the rising of the support plate 44, or in a predetermined length of time subsequent to the rising of the support plate 44, the upper piston-and-cylinder unit 56 lowers the support plate 58. Then, the upper and lower tapes Fa and Fb which are wound around the bundle of harness wires 1 by the forward movement of the bundle are pinched between the upper and lower opposed pinching pieces 69, 49, and contact between the contact pads 63, 64 and the heating pads 46, 47. When the heating element 53 is energized, the adhesive surfaces of the binding tapes Fa and Fb are heated and melted by the first set of heating pad 46 and contact pad 63 to provide a first sealed area S1, and simultaneously by the second set of heating pad 47 and contact pad 64 to provide a second sealed area S2, as seen from FIG. 7. The first sealed area S1 may, as shown in FIG. 7 include a plurality of distributed dots or perforations to provide an easily separable seal, whereas the second sealed area S2 is free of such spaces or voids, thus providing an inseparable seal.

The heating-and-sealing of tapes Fa and Fb is effected in one step at the instant of pinching the tapes between the contact pads 63, 64 and heating pads 46, 47 during the descent of the support plate 58. The support plate 58 continues descending by the upper cylinder unit 56 after the contact pads 63 and 64 are pushed against the heating pads 46, 47. Then, the slidable rod 59 rises through the support plate 58 while compressing the spring 67. The binding tapes, as wrapped around the wire harness bundle are then cut between their first and second sealed areas S1 and S2 by the knife 73 as it enters the slot 45*a* of the lower heating unit 45. After the completion of the tape adhesion-and-cutting step, the lower heating unit 45 is lowered, and the upper heating unit 62 is raised to expose a taped bundle of harness wires. The remaining tapes Fa and Fb have been sealed together at the second sealed area S2 and diverge both upwardly and downwardly to remain in a standby position across the wire path to bind a subsequent set of harness wires. The bundled harness wires (FIG. 7) may be easily unbound at the point of delivery by pulling the tabs of the first sealed area S1 apart from each other.

If desired, rather than two heating-and-pinching sets, a single heating-and-pinching set may be used. First, the single set will be operated to provide a first sealed area. The bundle of harness wires is then shifted forward so the single set may be operated again to provide a second sealed area spaced from the first area. The bundle of wires are moved downstream and the wrapped tapes Fa and Fb are cut and separated between the first and second sealed areas S1 and S2.

Figure 8:
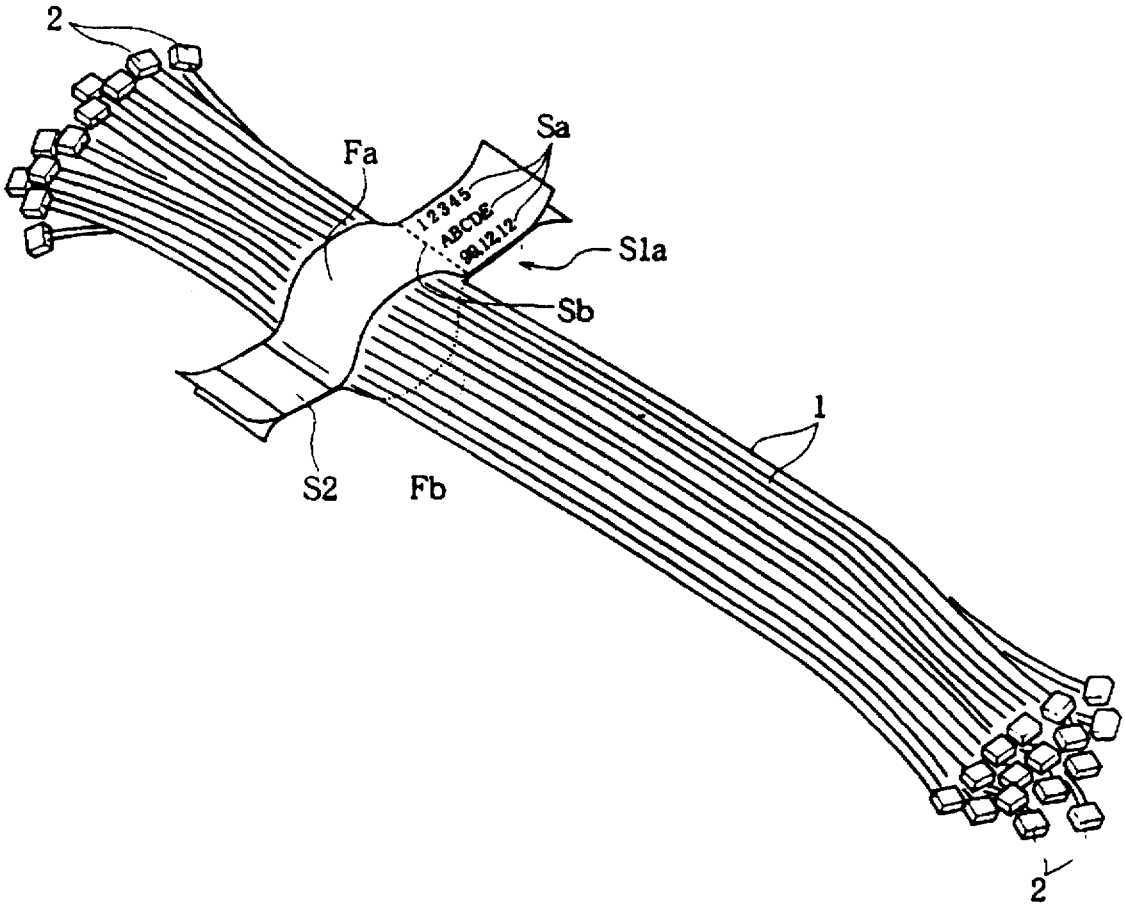
FIG. 8 is a perspective view of another bundle of wire harness which have identifying indicia imprinted on the tape.

FIG. 8 shows another example of a set of wire harnesses bound with tape in which the second sealed area S2 is inseparable and the first sealed area S1*a* is separable, having dots thereon in the form of alphanumeric patterns indicating the lot number, the manufacturing date or other indicia Sa. The dot-sealed area S1*a* can be easily broken by separating its opposite tabs apart from each other. If the dot-sealed area provides insufficient binding strength, an intermittent or very fine line seal Sb may be added for reinforcement. If the tape is of semi-opaque film such as polyacrylonitrile film, it will be transparent when heated, thereby advantageously permitting its alphanumeric indications to be sharply visible.

Figure 9:
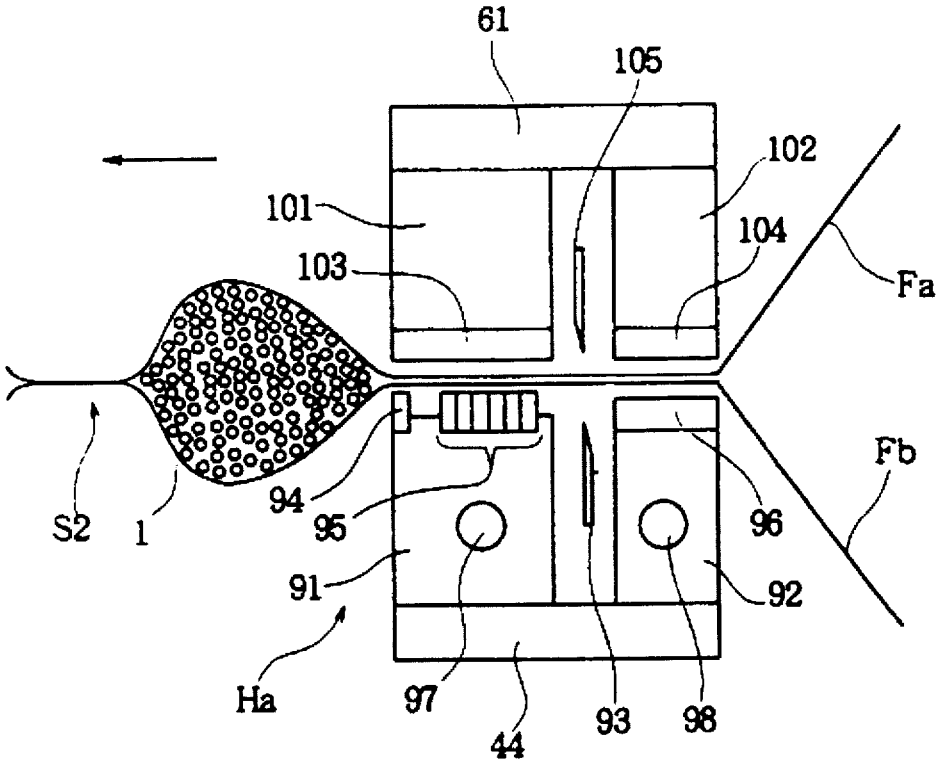
FIG. 9 is a view similar to FIG. 6 but showing the mechanism for imprinting the identifying indicia of FIG. 8.

Referring now to FIG. 9, an alternate heating-and-pinching unit Ha can be seen to include upper and lower confronting units with the lower unit having first and second heating assemblies 91, 92 fixed to its base support 44, and a cutter blade 93 provided between the heating assemblies 91, 92. The first heating assembly 91 has a heating plate 94 and a heating-and-impressing plate 95. The heating plate 94 is used in forming a linear-seal for reinforcement as indicated by Sb in FIG. 8 by way of linear-aligned dot projections to form a broken or intermittent line seal. The heating-and-impressing plate 95 is used in forming an alphanumeric pattern as indicated by Sa in FIG. 8. As such, it has dot projections arranged thereon in the desired alphanumeric pattern. If desired, the heating-and-impressing plate 95 can be changed. The heating units include respective heating elements 97, 98 embedded therein.

The upper part of the heating-and-pinching unit Ha has first and second elements 101 and 102 fixed to its base support 61, and a knife blade 105 provided therebetween. Each element has an abutment pad 103 or 104 on its lower face.

In this embodiment, a first heating-and-melting set is made up by impressing plate 95 and the contact pad 103 whereas a second heating-and-melting set is made up by the heating plate 96 and the contact pad 104. The cutting unit is made up by the two opposing knife blades 105 and 93.

The heating-and-cutting operation is performed in the same way as in the first embodiment. When a bundle of harness wires 1 is brought to the heating-and-pinching unit Ha, the base support 44 of the lower part is raised, and the base support 61 of the upper part is lowered, thus forming a first separable seal S1*a* at the heating plate 94, the heating-and-impressing plate 95 and its opposing contact pad 103. A second, inseparable seal S2 is formed by the heating plate 96 and its opposing contact pad 104. The binding tapes Fa and Fb are then cut intermediate of the first and second seals S1 and S2.

As may be understood from the above, a predetermined number of harnesses can be automatically bound with tape at an increased efficiency. A synthetic resin film is used as a binding tape, and a selected seal may be easily broken to unbind the binding of the bundle of electric wires.

It will be appreciated that the embodiments of the present invention discussed herein are merely illustrative of a few applications of the principles of the invention. Numerous modifications may be made by those skilled in the art without departing from the true spirit and scope of the invention.

We claim:

1. An wire harness bundling apparatus for binding a plurality of wire harnesses together into a bundle, comprising: carrier means for carrying the wire harnesses in sequential order; shifting means responsive to a predetermined number of wire harnesses carried by the carrier means for shifting them between an entrance of said apparatus and a harness bundling pathway; guide means defining the harness bundling pathway and for guiding the wire harnesses to a bundling tape application position; bundling tape feeding means interposed between the guide means and in said harness bundling pathway for feeding lengths of bundling tape across said pathway and applying said bundling tape around a bundle of said wire harnesses; heating-and-pinching means interposed between said guide means and interposed in said harness bundling pathway for heating, pinching and melting the bundling tape together on forward and rearward sides of the wire harness bundle to seal said binding tape around said wire harness bundle; drive means for reciprocatably driving the heating-and-pinching means together and apart from each other; and severing means operatively associated with said heating-and-pinching means for severing said bundling tape between the rearward side of one wire harness bundle and the forward side of a sequential wire harness bundle.

2. The wire harness bundling apparatus according to claim 1, wherein each said guide means includes a stationary guide member and a second guide member biased against the stationary guide member, the wires of said wire harnesses being held between said stationary and second guide members as they are advanced to said bundling tape application position, and said shifting means includes means for advancing the harness wires held between said stationary and second guide members.

3. The wire harness bundling apparatus according to claim 1, wherein said heating-and-pinching means includes first and second heating-and-pinching sets, and said severing means is disposed between the first and second heating-and-pinching sets.

4. The wire harness bundling apparatus according to claim 1, wherein said harness wire advancement means includes a harness wire ram capable of vertical and horizontal movement, the ram being movable in and out from said bundling tape application position.

5. The wire harness bundling apparatus according to claim 1, wherein said heating and pinching means includes a heater assembly and a contact pad assembly, the heater assembly having two heating surfaces disposed thereon and spaced apart from each other along said harness bundling pathway, the contact pad assembly having two contact surfaces spaced apart from each other along said harness bundling pathway and in opposition to said heating surfaces, said severing means being disposed between said two heating and contact surfaces.

6. The wire harness bundling apparatus according to claim 5, wherein at least one of said two heating and contact pad surfaces includes a plurality of projections extending therefrom which impart frangibility to a seal made therebetween with said bundling tape.

7. The wire harness bundling apparatus according to claim 5, wherein said shifting means includes means for advancing said wire harnesses along said wire harness bundling pathway into contact with said bundling tape extending across said wire harness bundling pathway, said two heating surfaces providing two heating surfaces providing two sealed areas on said binding tape, one of said two sealed areas being disposed at the rearward side of said wire harness bundle, the other of said two sealed areas being disposed at the forward side of the next wire harness bundle in sequence.

8. The wire bundling apparatus according to claim 1, wherein said heating-and-pinching means includes a heating assembly and a pinching assembly opposing each other and said drive means reciprocatably drives said heating and pinching assemblies into and out of contact with each other.

9. The wire bundling apparatus according to claim 8, wherein said heating assembly includes first and second heating surfaces disposed along said harness bundling pathway, the first and second heating surfaces being spaced apart of an intervening first recess and wherein said pinching assembly includes first and second contact surfaces disposed along said harness bundling pathway in respective opposition to said first and second heating surfaces, the first and second contact surfaces being spaced apart by a second recess, the second recess receiving said severing means therein in alignment with said first recess such that said first recess defines a shearing surface against which said severing means acts against to sever said bundling tape.

10. An apparatus for bundling a plurality of wire harnesses into a bundle by applying a bundling tape around the wires of the wire harnesses, the apparatus comprising:

carrier means for conveying a plurality of wire harnesses in sequential order into an entrance of said apparatus;

means for advancing said plurality of wire harnesses along a wirepath of said apparatus to gather a predetermined number of sequential wire harnesses into a bundle of wire harnesses;

means for interposing a bundling tape across said apparatus wirepath in a tape-application position;

means for wrapping said bundling tape around said bundle and onto itself;

means for sealing the folded binding tape on opposite sides of said bundle and for creating an inseparable seal on one side of said bundle and a separable seal on the other side of said bundle; and means for severing said bundling tape between said inseparable and separable seals of consecutive wire harness bundles.

11. The apparatus as defined in claim 10, further including guide means for guiding said wire harnesses along said wirepath, the guide means including at least one stationary rail which receives said wire harnesses thereupon in sequential order, said guide means further including at least one moveable rail confronting said stationary rail and biased into opposition therewith to thereby hold said wire harnesses thereagainst during advancement thereof through said apparatus along said wirepath.

12. The apparatus as defined in claim 11, wherein said wire harness advancing means includes an advancement member movable along said wirepath for moving said wire harnesses from said carrier means into said group of wire harnesses at said tape-application position, said advancement member further being vertically displaceable to bridge any vertical gap between said carrier means and said guide means.

13. The apparatus as defined in claim 10, wherein said bundling tape wrapping means and sealing means include two opposing, reciprocatable assemblies, one of said assemblies including first and second heating surfaces disposed thereon and a heating element for heating said first and second heating surfaces, the other of said assemblies having first and second reaction surfaces disposed thereon in opposition to said first and second heating surfaces, said first and second heating surfaces and said first and second reaction surfaces contacting opposite sides of said bundling tape when forming said inseparable and separable seals.

14. The apparatus as defined in claim 13, wherein both of said one and other assemblies include respective recesses disposed between said respective first and second heating surfaces and said first and second contact surfaces, one of said recesses including said severing means.

15. The apparatus as defined in claim 13, wherein one of said first and second heating surfaces contains a plurality of projections which form said separable seal when pressed against said bundling tape.

16. The apparatus as defined in claim 14, wherein said severing means includes a severing blade disposed in one of said recesses disposed between said first and second contact surfaces, the severing blade being aligned with said other recess disposed between said first and second heating surfaces so as to effect a shearing action between said severing blade and said other recess when said two assemblies are brought together into contact with said bundling tape.

17. The apparatus as defined in claim 13, wherein one of said first and second heating surfaces includes identifying indicia disposed thereon.

18. The apparatus as defined in claim 13, wherein said first heating and contact surfaces cooperate to form said inseparable seal when contacting said binding tape and said second heating and contact surfaces cooperate to form said separable seal when contacting said binding tape.

19. The apparatus as defined in claim 10, wherein said inseparable seal is formed on a forward side of said bundle and said separable seal is formed on a rearward side of said bundle.

* * * * *